US011764518B2

(12) United States Patent
Ge et al.

(10) Patent No.: US 11,764,518 B2
(45) Date of Patent: Sep. 19, 2023

(54) PUSH-PULL ELECTRICAL CONNECTOR

(71) Applicant: Weidmuller Interface GmbH & Co. KG, Detmold (DE)

(72) Inventors: Xuefeng Ge, Henrico, VA (US); Matthias Bönsch, Bielefeld (DE)

(73) Assignee: Weidmuller Interface GmbH & Co. KG, Detmold (DE)

( * ) Notice: Subject to any disclaimer, the term of this patent is extended or adjusted under 35 U.S.C. 154(b) by 1 day.

(21) Appl. No.: 17/394,959

(22) Filed: Aug. 5, 2021

(65) Prior Publication Data

US 2023/0045173 A1 Feb. 9, 2023

(51) Int. Cl.
*H01R 13/633* (2006.01)
*H01R 13/627* (2006.01)

(52) U.S. Cl.
CPC ..... *H01R 13/633* (2013.01); *H01R 13/6275* (2013.01)

(58) Field of Classification Search
CPC ... H01R 13/629; H01R 13/633; H01R 13/639; H01R 13/6271; H01R 13/6275; H01R 13/6582
See application file for complete search history.

(56) References Cited

U.S. PATENT DOCUMENTS 5,011,424 A * 4/1991 Simmons ..... H01R 13/6275 439/352
5,580,268 A * 12/1996 Miyazawa ..... H01R 13/6583 439/352
5,634,809 A * 6/1997 Hirai ..... H01R 13/6275 439/352
6,227,895 B1 5/2001 Mc Farlane
9,570,860 B1* 2/2017 Chien ..... H01R 13/6582
2006/0063415 A1* 3/2006 de Vanssay et al. H01R 13/6275 439/350
2015/0229075 A1* 8/2015 Lin et al. ..... H01R 13/6582 439/153
2021/0057850 A1 2/2021 Wolf

FOREIGN PATENT DOCUMENTS

EP 3790121 A1 3/2021
WO 2015063048 A1 5/2015

* cited by examiner

*Primary Examiner* — Oscar C Jimenez
(74) *Attorney, Agent, or Firm* — Laubscher & Laubscher PC

(57) ABSTRACT

The invention relates to a plug connector (300), having: a receiving element (10) for receiving a plug-in element of the first type (100) or a plug-in element of the second type (200) at least in certain areas; and - a push-pull locking system (20) for producing a push-pull locking between the connector (300) and the plug-in element of the first type (100); wherein the push-pull locking system (20) has at least one locking element (13) which is arranged at least regionally in a recess (14) of the receiving element (10) provided for the at least one locking element (13), and wherein the receiving element (10) has at least one latching means (12) which is provided and designed to with at least one complementary latching means (230) of the plug element, of the second type (200) to be brought into engagement.

10 Claims, 11 Drawing Sheets

PUSH-PULL ELECTRICAL CONNECTOR

BACKGROUND OF THE DISCLOSURE

The present disclosure relates generally to electrical connectors, and more specifically to push-pull connectors.

Push-pull connectors are known in the art. Such connectors provide a simple yet effective way to secure a cable connection with a mating plug to prevent accidental disconnections. A typical push-pull connector includes a receptacle housing with an insert and a sleeve for connecting the insert with a mating plug. The receptacle housing has a locking mechanism for connecting the receptacle housing with a mating plug housing to secure the electrical connection between the insert and plug. To release the receptacle housing and insert from the mating plug, the sleeve is typically squeezed or slid away from the housing insert and the receptacle housing is pulled from the mating plug housing, thus allowing a single pulling motion away from the mating plug to release the receptacle housing and the insert from the mating plug.

The Wolf U.S. Pat. Application Publication No. 2021/0057850 discloses a push-pull plug connector that includes a housing and sleeve configured for connection of an insert with a mating plug. The sleeve includes latching hooks and a polarization element. When the sleeve is arranged over the housing, an insert is connected with the housing, and the housing is connected with a mating plug, the sleeve latching hooks and polarization element secure the housing with the mating plug. To remove the connector housing, the sleeve is slid away from the insert to disengage the hooks and polarization element from the mating plug and remove the push-pull connector.

Despite the above-noted push-pull connectors and others known in the art, there is a need to improve such connectors to increase security in connections between connectors and mating plugs or panels, while providing ease in connecting and removing push-pull connectors.

SUMMARY OF THE DISCLOSURE

Accordingly, it is an object of the present disclosure to provide a push-pull connector for a panel containing at least one opening corresponding with at least one circuit board. The connector includes a housing with a spring hook and a shell connected therewith. The housing has an outer surface, at least one circuit board connector arranged at a first open end thereof, and a second end configured to receive an electrical cable for connection with at least one circuit board connector. The spring hook is connected with the housing outer surface and is operable between a hold position where the housing is connected with the panel at the at least one panel opening and a release position wherein the housing is disconnected from the panel. The shell is slidably connected with the housing outer surface for displacement between a release position and a hold position, wherein the shell or housing are moved toward and away from each other to operate the spring hook toward the release and hold position, respectively. Preferably, an edge of the shell includes at least one projection having an inclined surface configured for engagement with the at least one spring hook to operate the spring hook between the hold and release positions securing or releasing the connector with a circuit board panel, respectively.

In one embodiment, the at least one spring hook has a central body portion and at least one angled upper edge extending from the body portion. When the shell is moved toward the housing or the housing toward the shell, the projection inclined surface contacts the angled upper edge to flex the spring hook central body portion and operate the spring hook toward the release position.

In another embodiment, the shell includes two pairs of opposed spaced projections and the housing includes two opposed spring hooks, each having a pair of spaced angled upper edges extending from the central body portion, wherein the shell projections contact the spring hook angled upper edges to flex the spring hook central body portion to operate the spring hook toward the release position. Preferably, the shell contains a pair of opposing recesses each located between the spaced projections, and the housing contains a pair of corresponding recesses with which the spring hooks are connected.

In yet another embodiment, the shell and housing have a generally rectangular configuration in a cross-section, and the shell is connected with the housing via at least one snap fit connection.

BRIEF DESCRIPTION OF THE FIGURES

Other objects and advantages of the disclosure will become apparent from a study of the following specification when viewed in the light of the accompanying drawing, in which.

DETAILED DESCRIPTION

Figure 1:
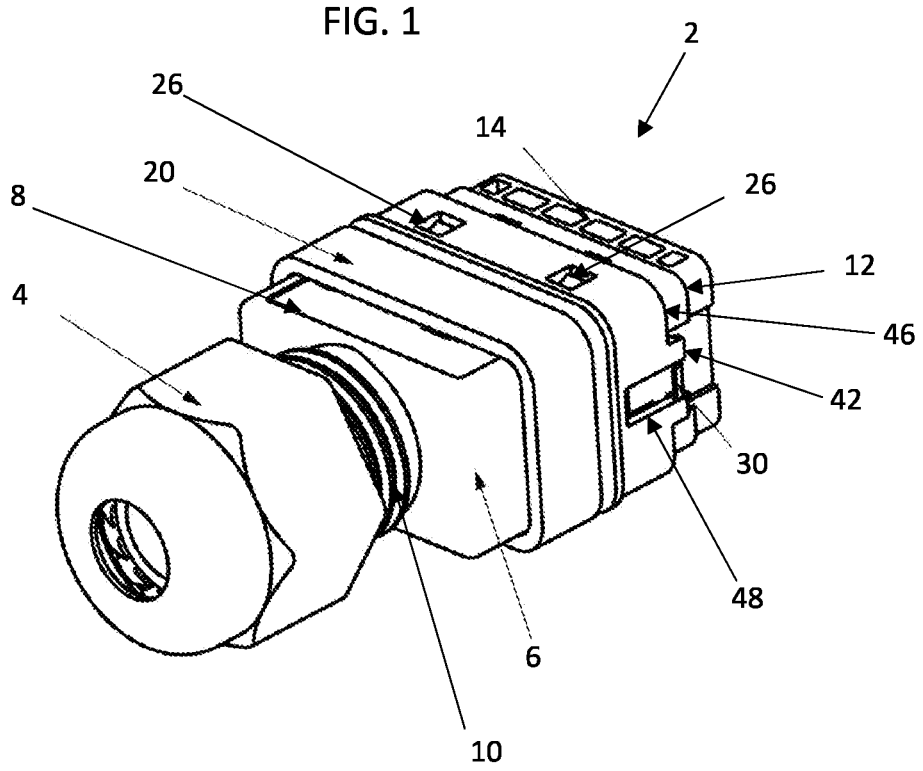
FIGS. 1 and 2 are front and rear perspective views, respectively, of a push-pull connector according to the present disclosure.
Figure 2:
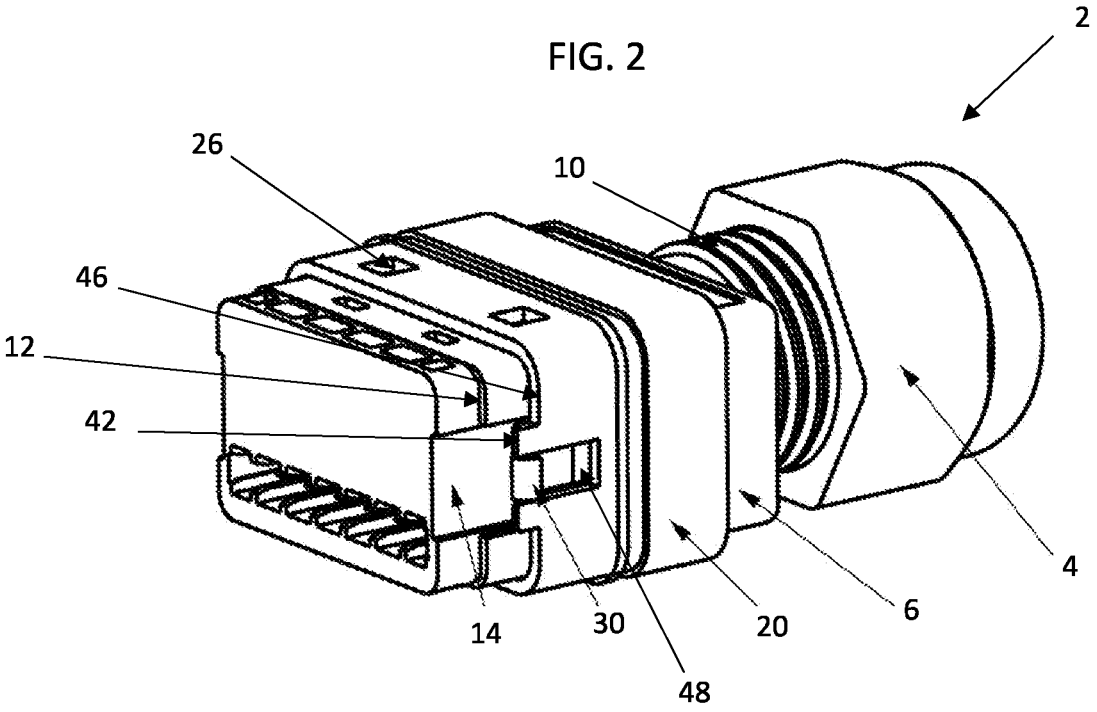
Figure 5:
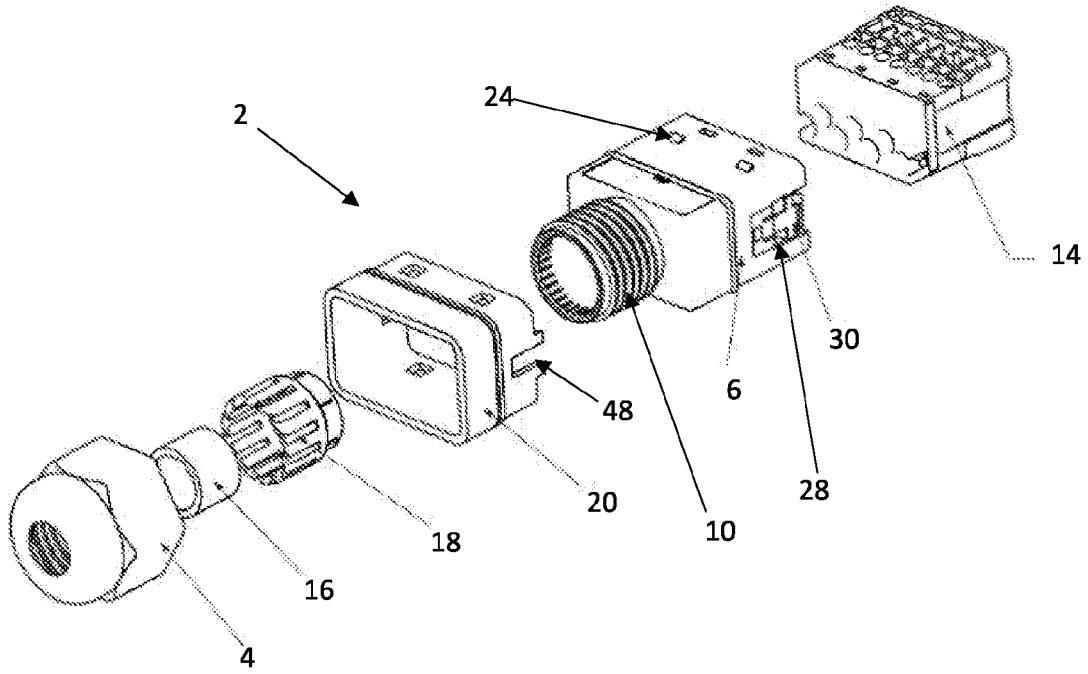
FIGS. 5 and 6 are front and rear exploded perspective views, respectively, of the push-pull connector and circuit board of FIGS. 1 and 2 with the spring hooks connected with the housing.
Figure 6:
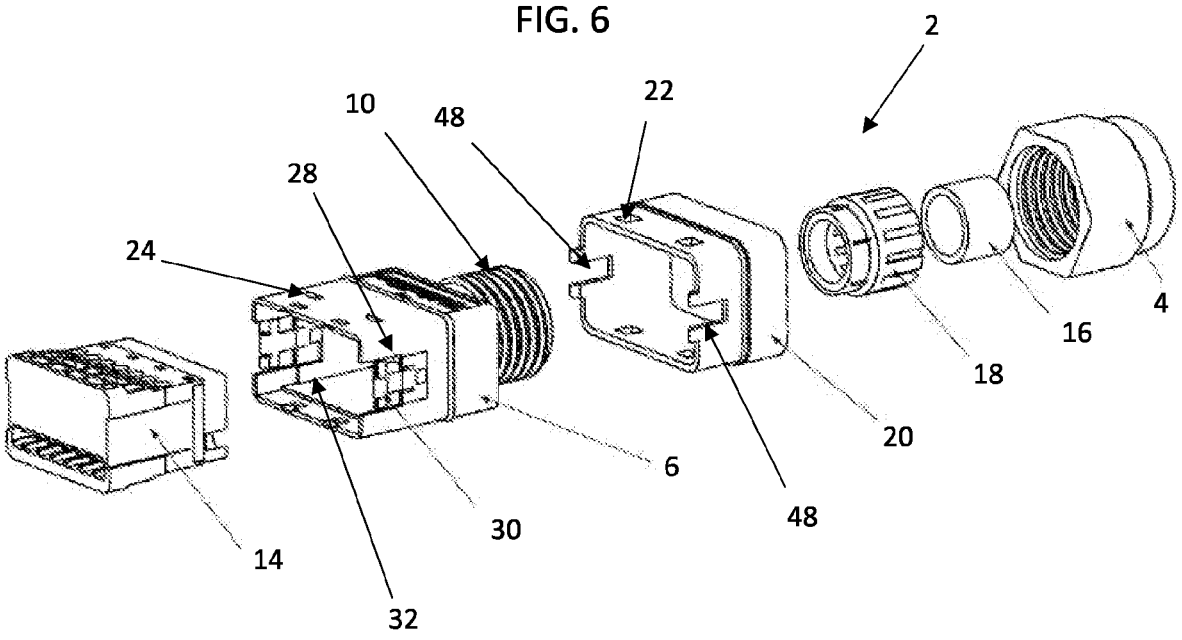

The present disclosure relates to a push-pull connector for a circuit board panel. Referring first to FIGS. 1 and 2, the push-pull connector 2 includes a gland 4 connected with a rectangular housing 6 having an outer surface 8. The housing includes a first threaded end 10 connected with the gland and a second open end 12 which has an insert 14 arranged therein. FIGS. 5 and 6 show a seal 16 and claw 18 which together secure a cable (not shown) within the gland.

Figure 3:
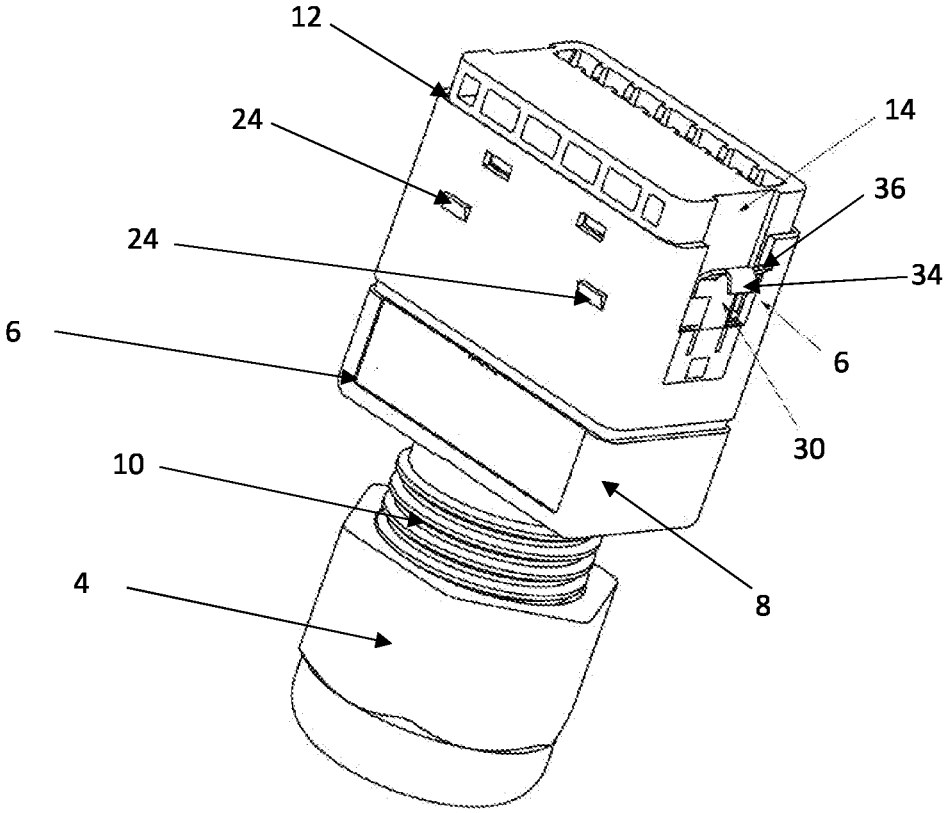
FIG. 3 is a perspective view of the push-pull connector of FIG. 1 with the shell removed.
Figure 4:
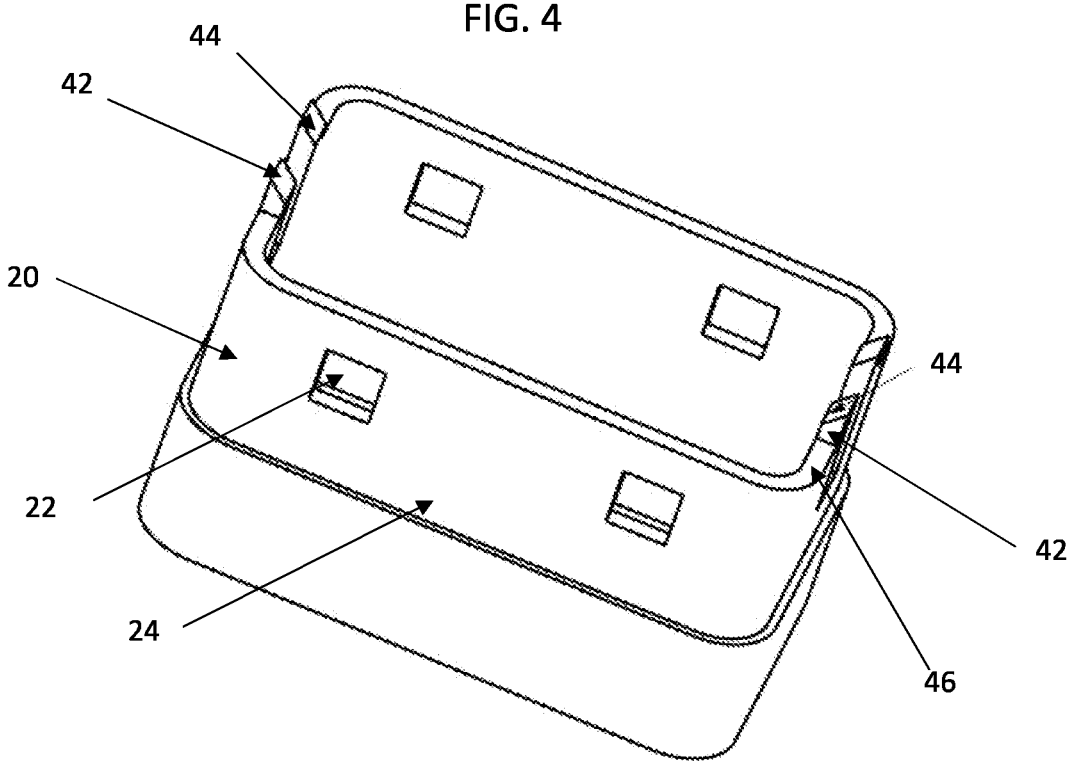
FIG. 4 is a perspective view of the push-pull connector shell shown in FIG. 1.

Referring again to FIGS. 1 and 2, a rectangular shell 20 is arranged over the outer surface 8 of the housing 6 and slidably connected therewith. Shown in FIG. 4, the shell contains a pair of openings 22 arranged on a sidewall of the shell which correspond with a pair of projections 24 arranged on the housing outer surface, which are shown in FIG. 3. The shell openings and housing projections together form a snap-fit connection 26 for retaining the shell on the housing. The size of the shell openings relative to the size of the housing projections allows for slidable movement of the shell relative to the housing. As discussed below, this movement provides a mechanism for disconnecting the push-pull connector from a circuit board panel.

Figure 7:
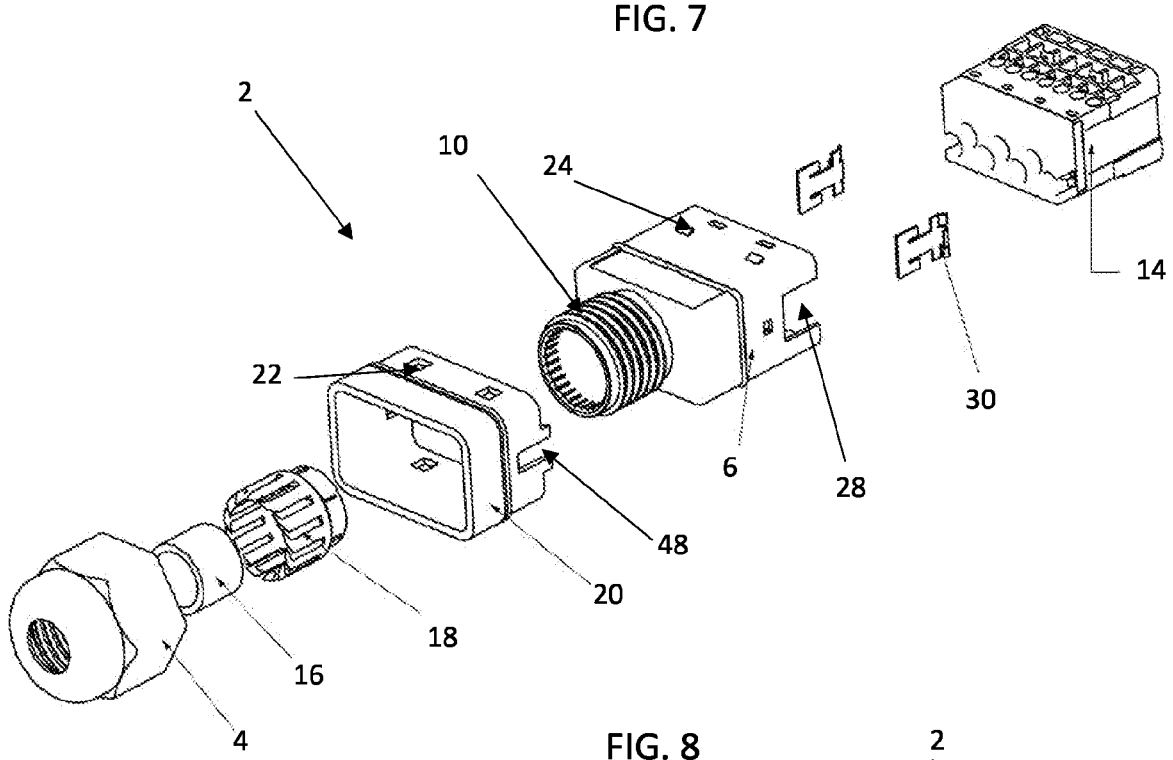
FIGS. 7 and 8 are front and rear exploded perspective views, respectively, of the push-pull connector of FIGS. 1 and 2 with the spring hooks disconnected from the housing.
Figure 8:
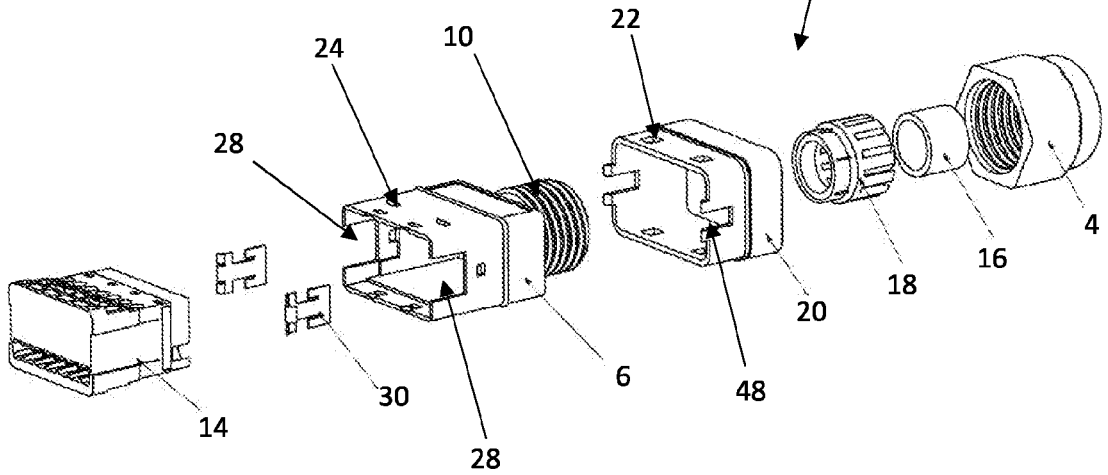
Figure 9:
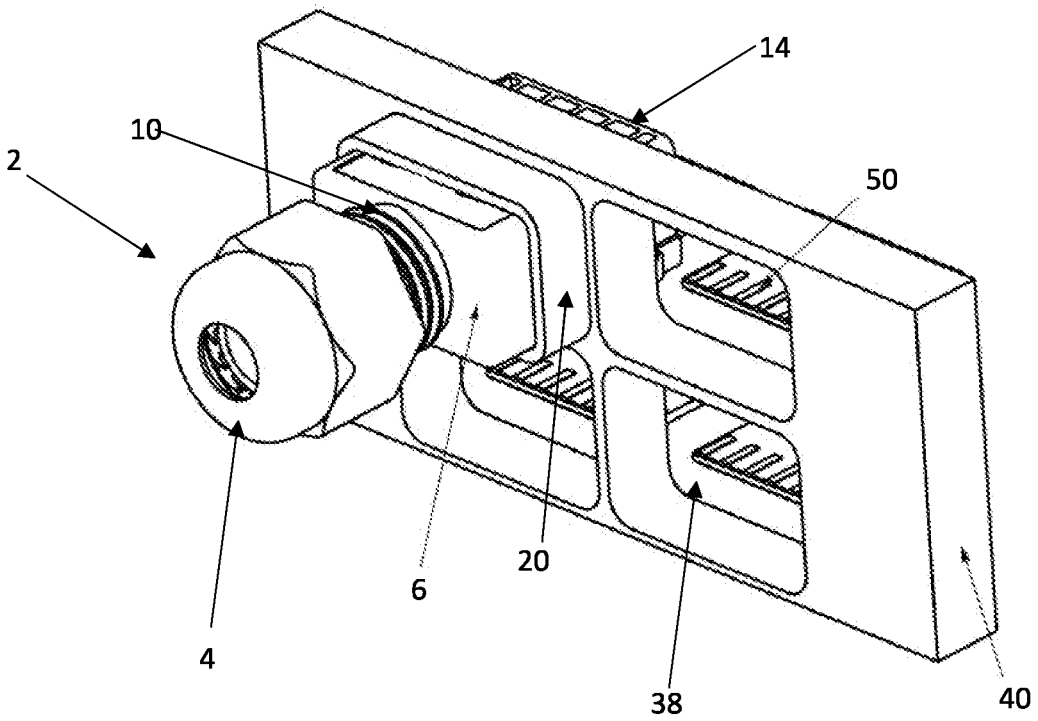
FIGS. 9 and 10 are front perspective views of the push-pull connector of FIGS. 1 and 2 connected and disconnected, respectively, with a circuit board.
Figure 10:
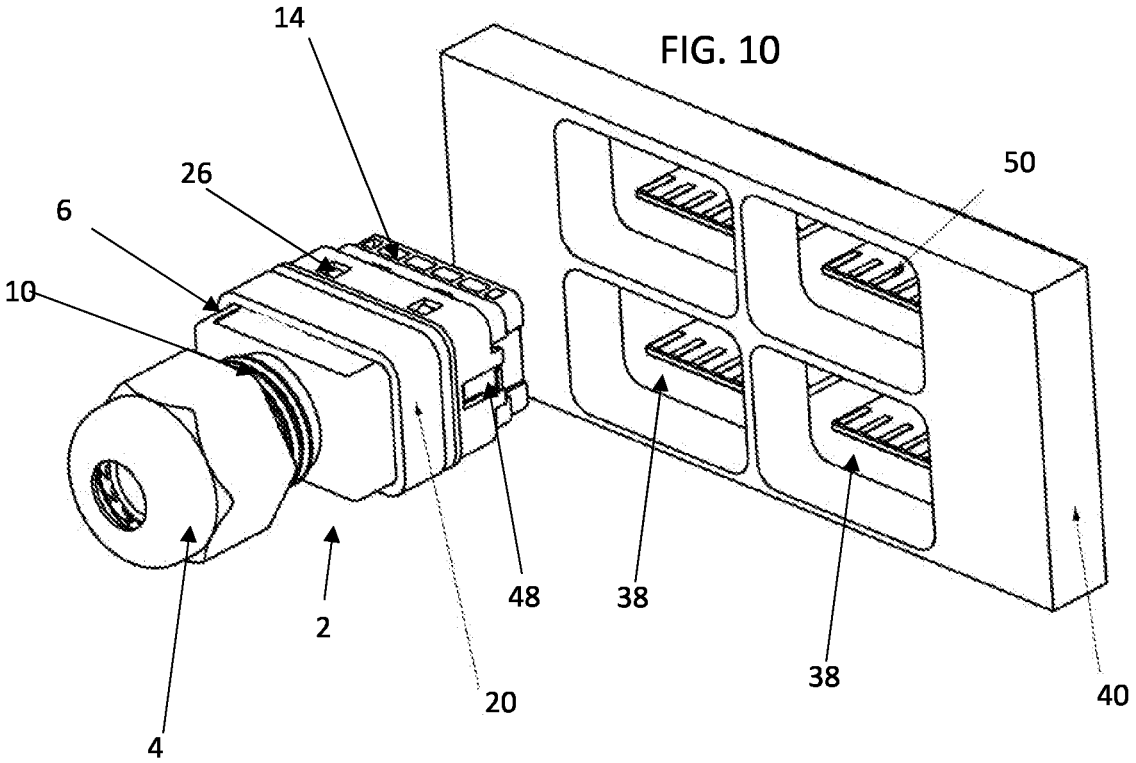
Figure 11:
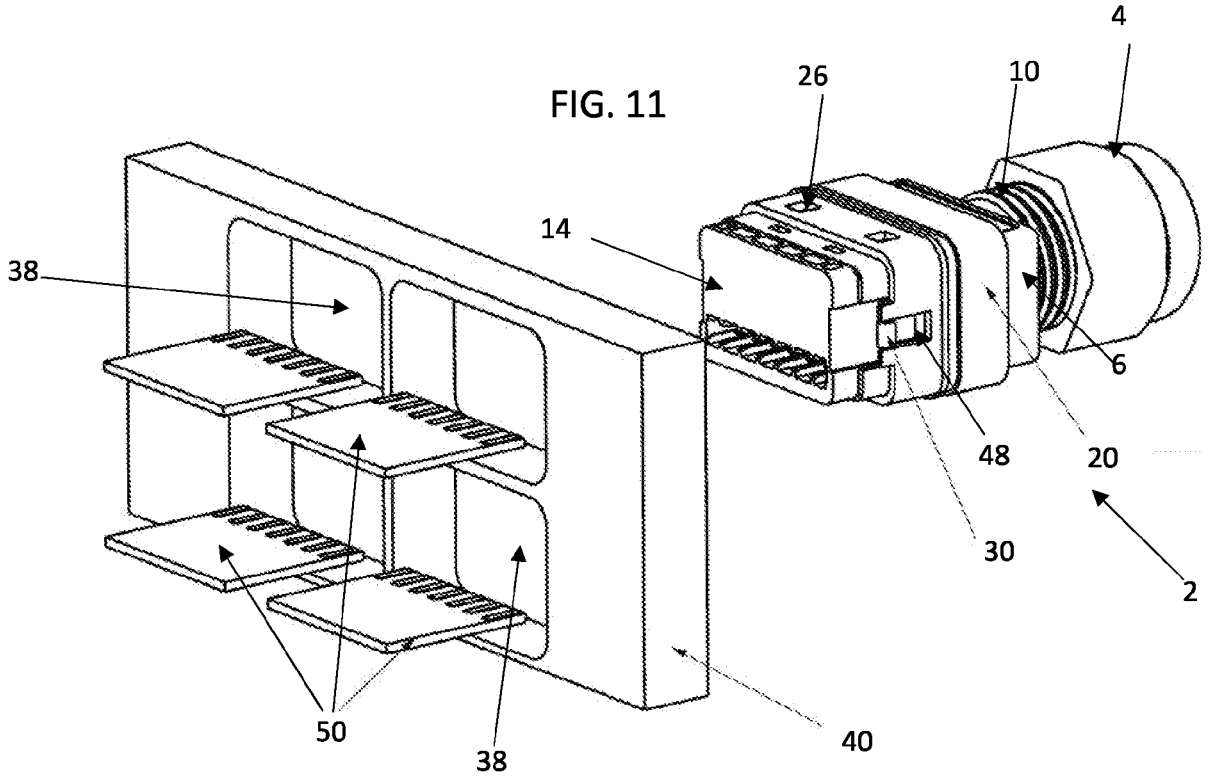
FIGS. 11 and 12 are rear perspective views of the push-pull connector of FIGS. 1 and 2 connected and disconnected, respectively, with a circuit board.
Figure 12:
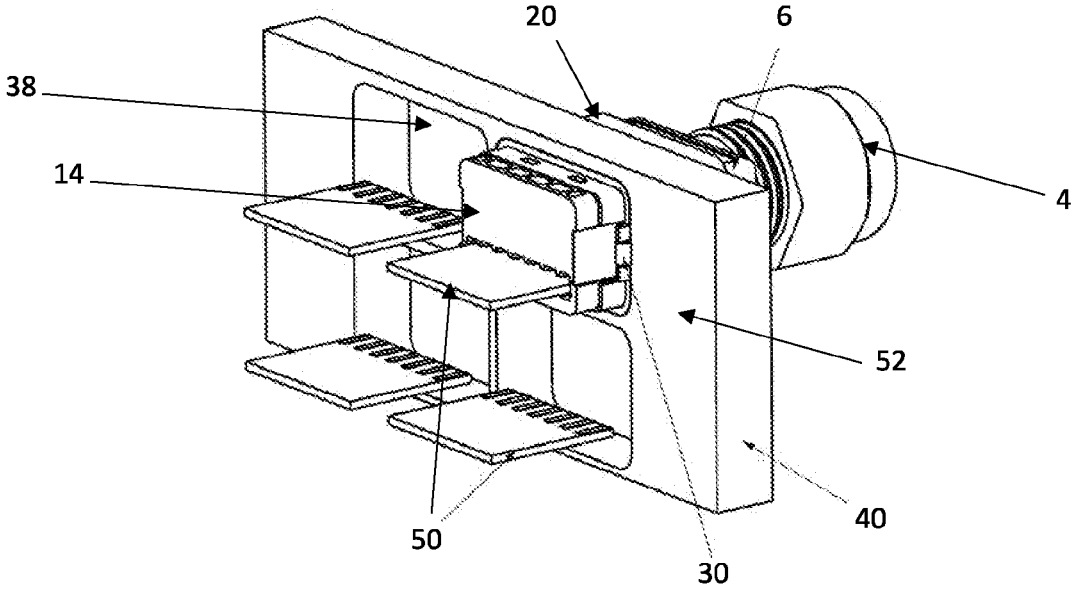
Figure 13:
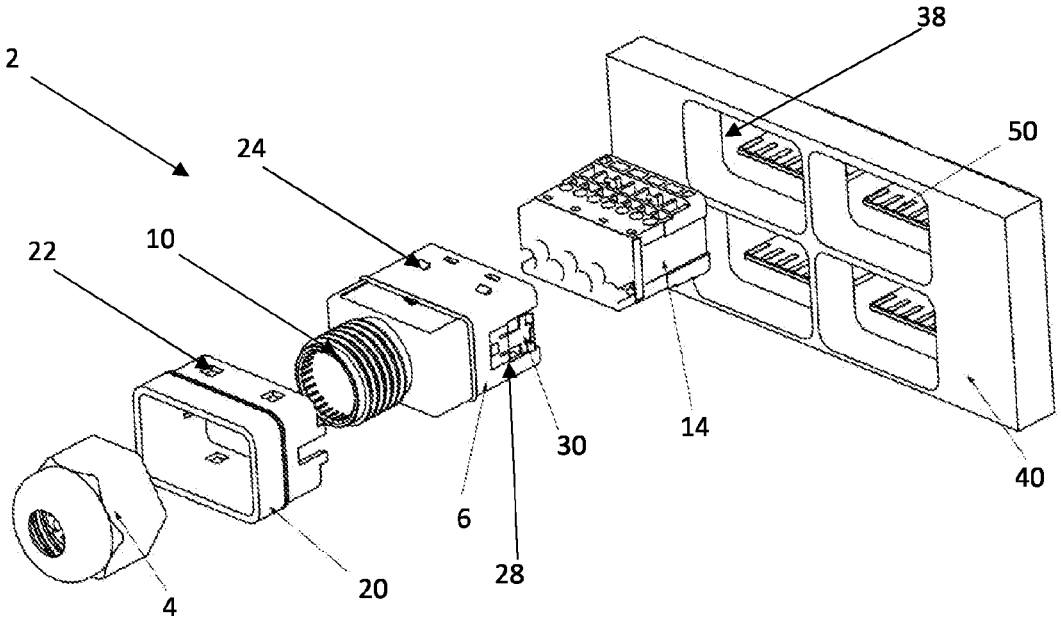
FIGS. 13 and 14 are front and rear exploded perspective views, respectively, of the push-pull connector of FIGS. 1 and 2 with the circuit board panel.
Figure 14:
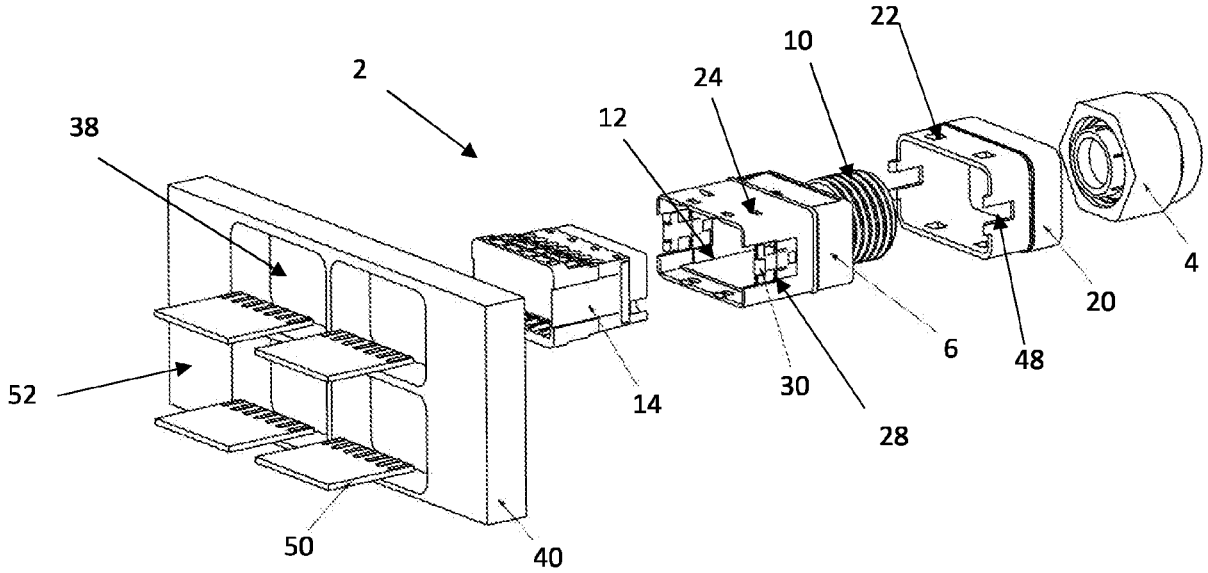
Figure 17:
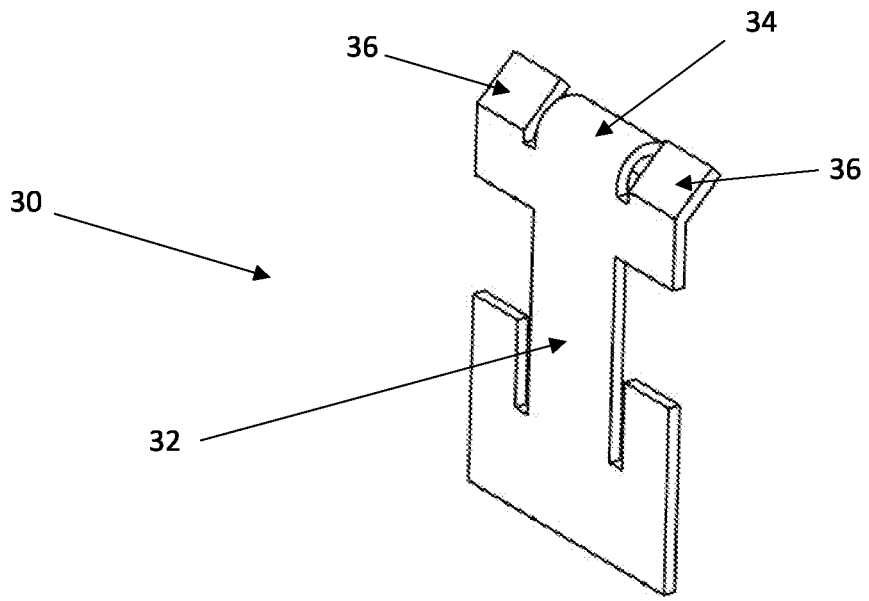
FIGS. 17 and 18 are front and rear perspective views, respectively, of a spring hook according to the present disclosure.
Figure 18:
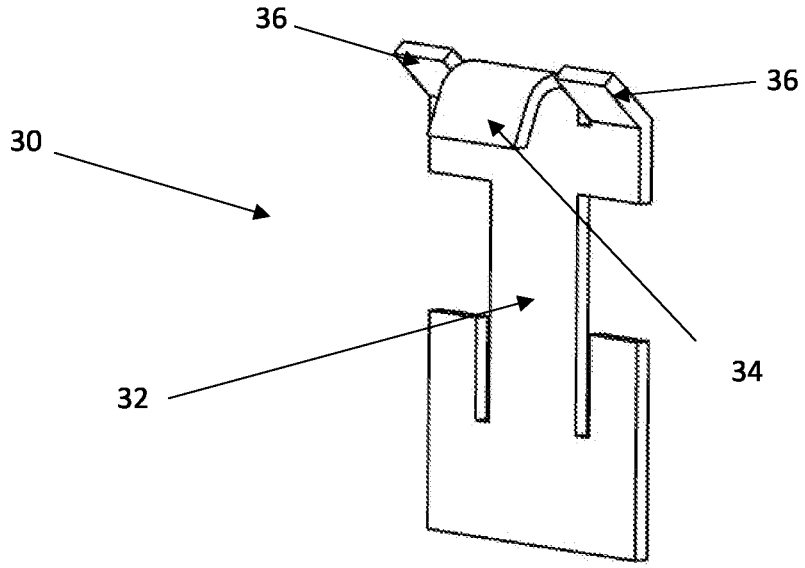

Referring now to FIGS. 7 and 8, the housing 6 contains a pair of side wall recesses 28 within which a pair of spring hooks 30 are arranged. FIGS. 5 and 6 show the spring hooks when they are connected with the housing recesses. As shown in greater detail in FIGS. 17 and 18, the spring hooks each include a body portion 32, a hook portion 34 extending outwardly from an upper portion of the body portion, and a pair of angled upper edges 36 arranged on either side of the hook portion. As will be discussed in further detail below and as shown in FIG. 12, the hook portions hold the push-pull connector 2 against a circuit board panel when inserted within an opening 38 of a panel 40 to ensure the connector is not unintentionally disconnected from the panel.

Figure 21:
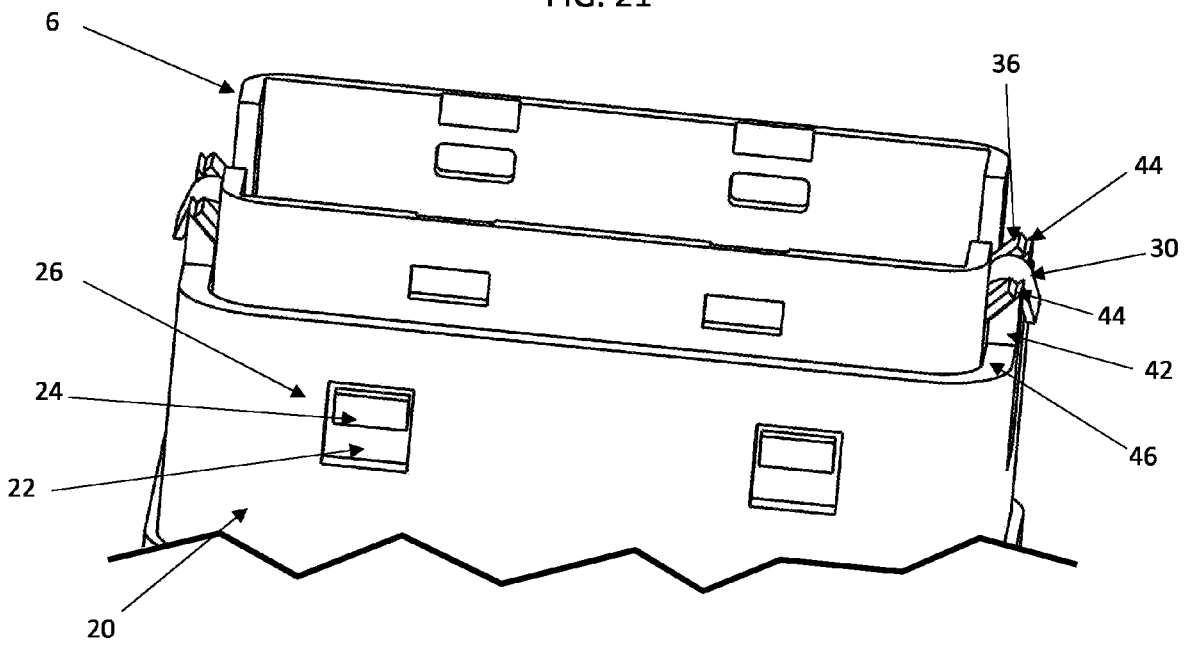
FIG. 21 is a perspective view of the push-pull connector of FIG. 1 with the spring hooks in their hold position.

Referring again to FIG. 4, the shell includes two pairs of spaced projections 42 each having an inclined surface 44 arranged at a side wall edge 46 of the shell 20. These projections are configured to correspond with the angled upper edges 36 of the spring hooks 30 as shown in FIG. 21. As shown in FIGS. 5 and 6, the shell projections define a pair of side wall shell recesses 48 which allow for the hook portion 34 of the spring hook to flex between hold and release positions when connecting and disconnecting the push-pull connector 2 with the panel 40.

Figure 15:
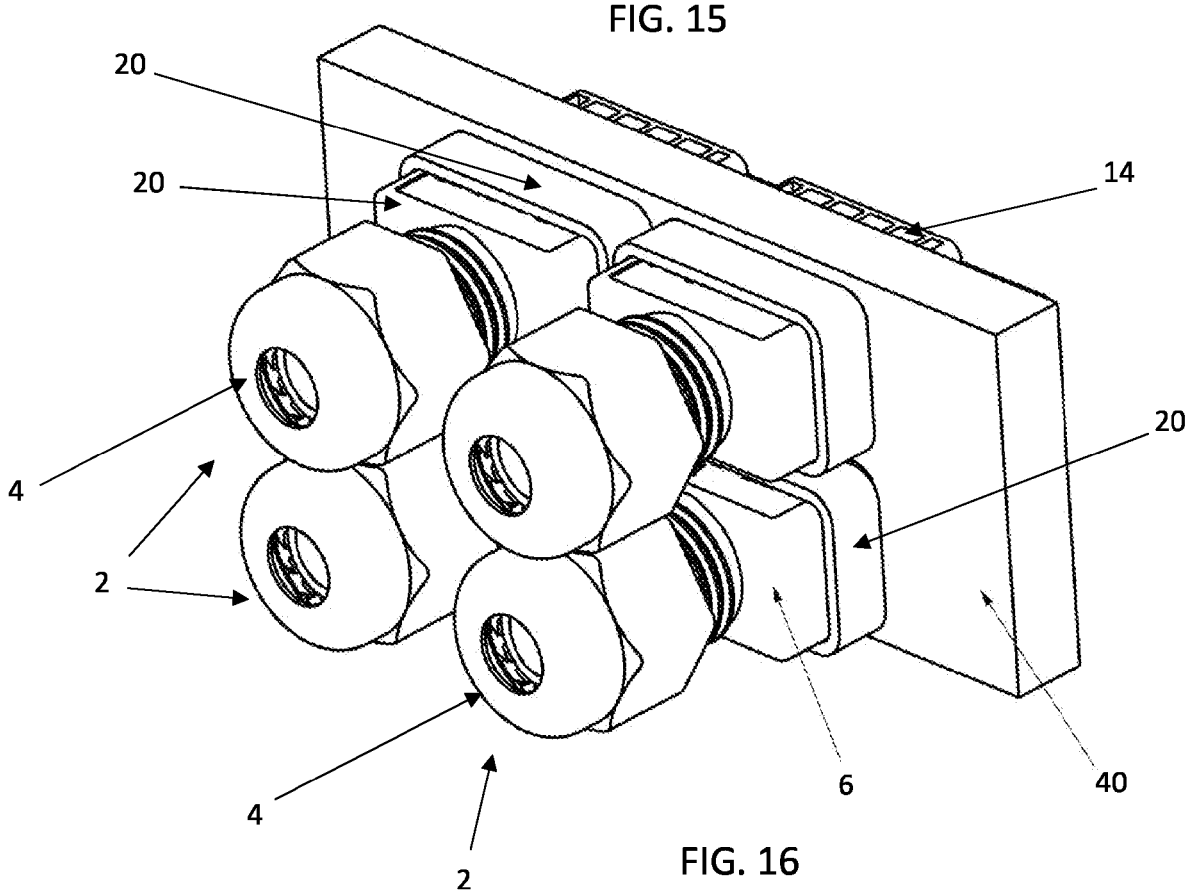
FIGS. 15 and 16 are front and rear perspective views, respectively, of four push-pull connectors connected with respective circuit boards according to the present disclosure.
Figure 16:
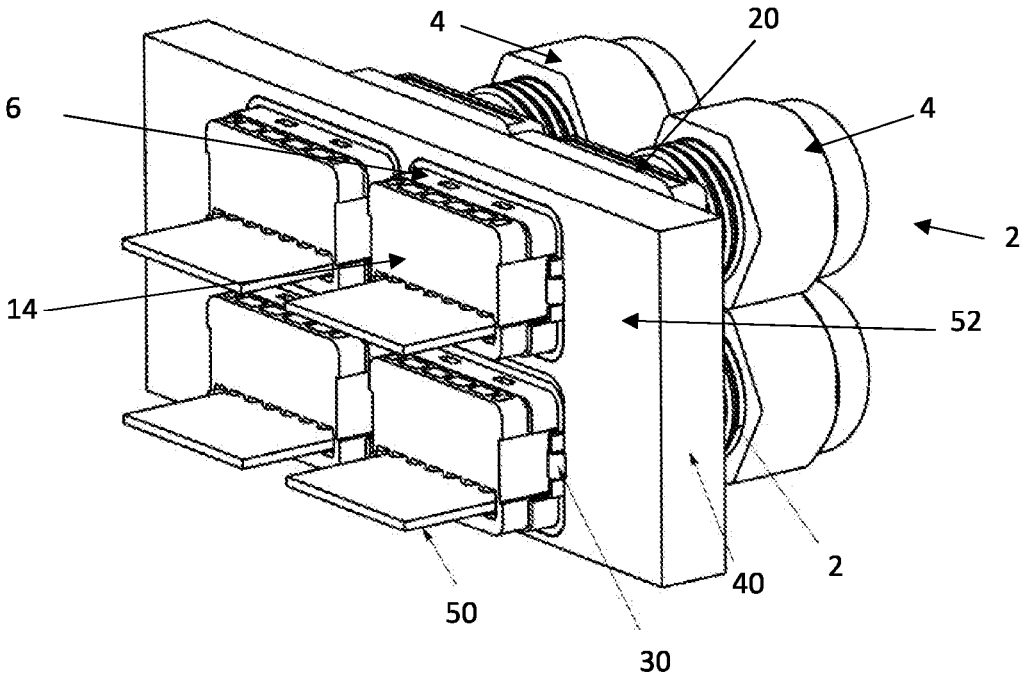
Figure 19:
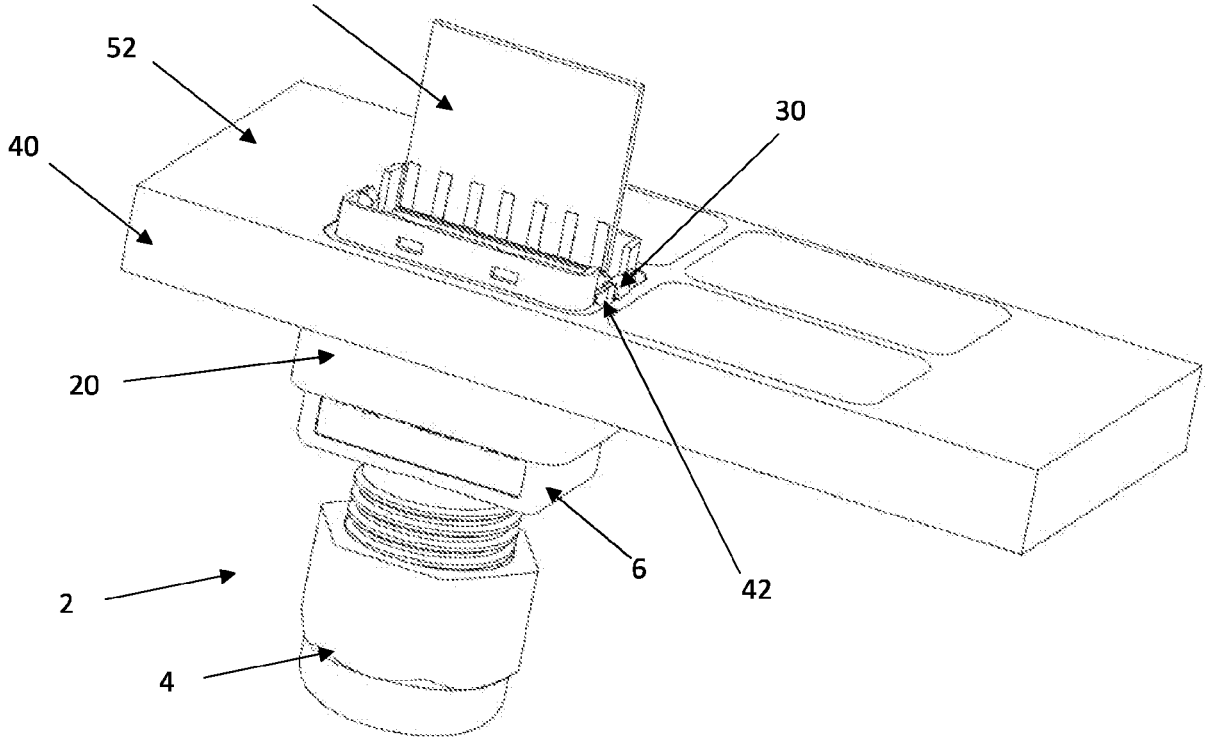
FIG. 19 is a bottom perspective view of the push-pull connector of FIG. 1 connected with a circuit board.
Figure 20:
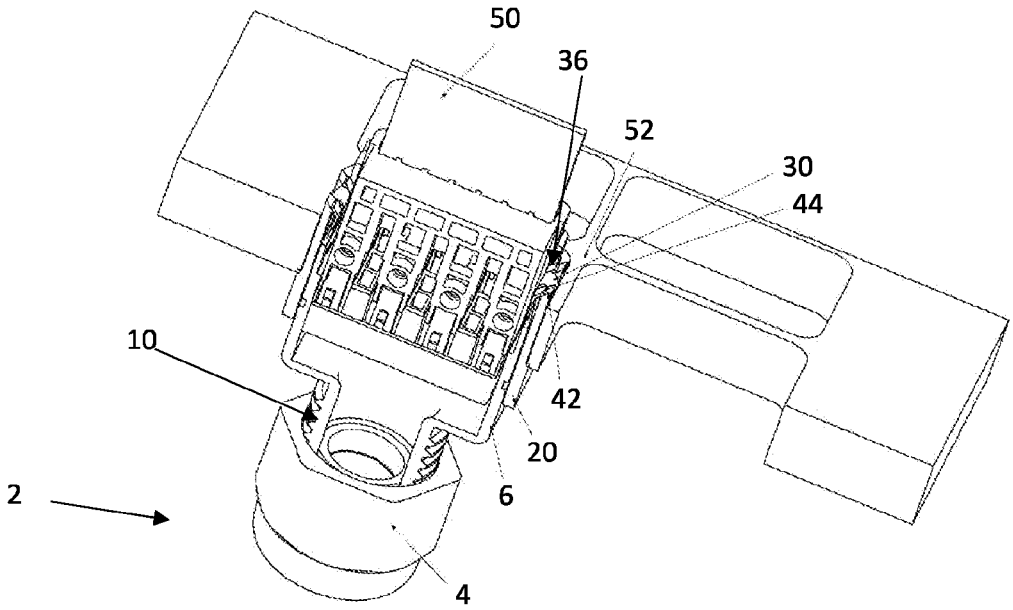
FIG. 20 is a cross-sectional bottom perspective view of the push-pull connector of FIG. 1 connected with a circuit board.
Figure 22:
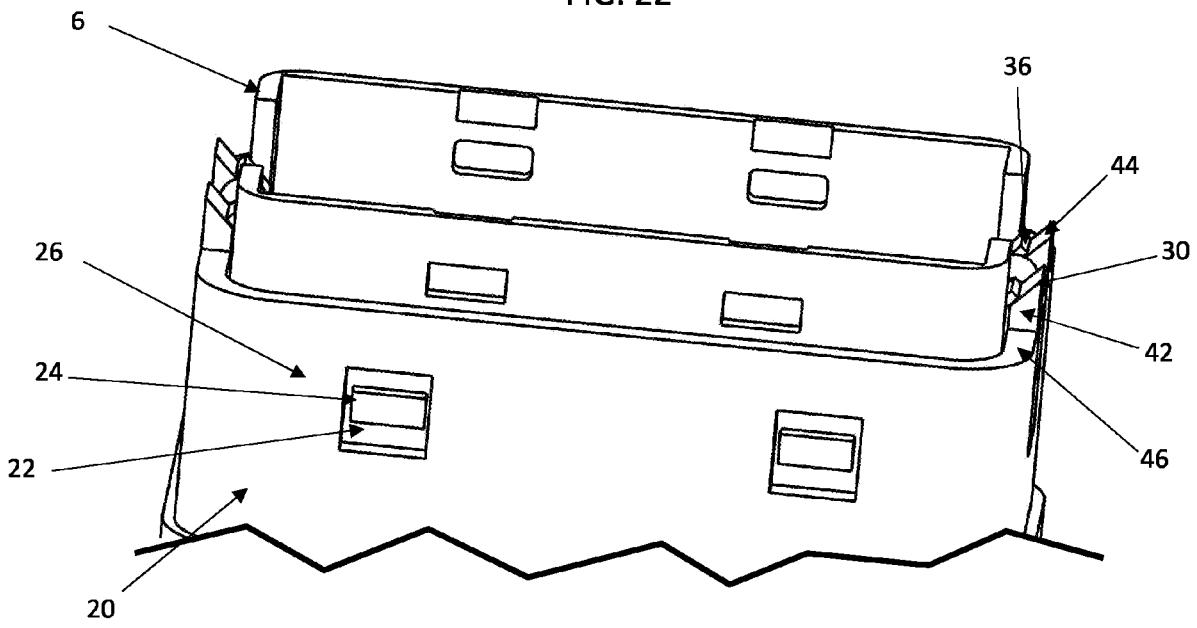
FIG. 22 is a perspective view of the push-pull connector of FIG. 1 with the spring hooks in their release position.

Referring again to FIG. 21, when the shell 20 is connected with the housing 6, the shell projections 42 are in contact with the spring hook angled upper edges 36. The push-pull connector insert 14 can then be connected with a circuit board 50, which in turn will cause the spring hooks 30 to latch onto a rear wall 52 of the circuit board panel 40, as shown in FIG. 19. FIGS. 15 and 16 show four such push-pull connectors 2 connected with a circuit board panel 40. To release the push-pull connector 2 from the circuit board and panel, the shell is pushed toward the panel which results in the shell projections engaging the spring hooks to flex them into a release position, which is shown in FIG. 20. At this time, the hook is no longer latched to the panel rear wall, and the push-pull connector can be removed from the circuit board and panel. FIGS. 21 and 22 illustrate the spring hook in its hold and release positions, respectively.

The function of the push-pull connector 2 of the present disclosure will now be discussed in further detail. As shown in FIG. 19, when the push-pull connector is connected with a circuit board panel 40 through a panel opening 38, the insert 14 and the circuit board 50 are connected, and the spring hooks 30 latch to the rear wall 52 of the panel. The latched spring hooks ensure that the push-pull connector will remain in place to prevent unintended disconnections, but also allows for easy disengagement of the hook and in turn disconnection of the connector.

As shown in FIG. 20, to release the push-pull connector 2 from the panel 40, the shell 20 is slid toward the panel causing the shell projections 42 to engage the spring hook angled upper edges 36 to flex the hook 34 away from the panel rear wall 52. Once the hook is no longer latched with the panel, the push-pull connector can be pulled away from the panel to disconnect the insert 14 from the circuit board 50 and remove the push-pull connector from the panel.

Referring again to FIGS. 21 and 22, the interaction between the shell 20 and housing 6, and thus the shell projections 42 and spring hooks 30, is shown in greater detail. FIG. 21 shows the shell connected with the housing and the shell projections in contact with but not engaging the spring hook angled upper edges 36. FIG. 22 illustrates the position of the shell, the shell projections and the spring hooks once the shell is slid or pushed toward the housing insert opening 12. As the shell is pushed toward the opening, the shell projection engages the spring hook angled upper edges, forcing them inward through the housing recess 28 causing the hook 34 to in turn be flexed inward through the housing recess. As the projections engage the spring hook, they slide up the angled upper edges. The shell recesses 48 provide space for the spring hook such that as the projections slide up the angled upper edges, the shell will not contact the hook portion of the spring hook. As discussed above, this movement allows for the push-pull connector 2 to be easily disconnected from a circuit board panel 40.

Although the above description includes references to particular embodiments, it is to be understood that these embodiments are merely illustrative of the principles and applications of the present disclosure. It is therefore to be understood that numerous modifications may be made to the illustrative embodiments and that other arrangements may be devised and employed without departing from the spirit and scope of the present disclosure.

What is claimed is:

1. A push-pull connector for a panel containing at least one opening corresponding with at least one circuit board, respectively, comprising:

(a) a housing having an outer surface and containing at least one circuit board connector arranged at a first open end thereof, a second end of said housing being configured to receive an electrical cable for connection with said at least one circuit board connector;

(b) a pair of spring hooks each connected with opposite sides of said housing outer surface and operable between a hold position where said housing is connected with the panel at the at least one panel opening and a release position wherein said housing is disconnected from said panel; and (c) a shell slidably connected with said housing outer surface for displacement between a release position wherein one of said shell and said housing are moved toward each other to operate said pair of spring hooks toward said release position and a hold position wherein said shell and said housing are moved away from each other to allow movement of said pair of spring hooks toward said hold position, whereby said housing connects the at least one circuit board connector with the at least one circuit board when said housing is connected with the panel at the at least one panel opening.

2. The push-pull connector as defined in claim 1, wherein an edge of said shell includes at least one projection configured for engagement with said pair of spring hooks.

3. The push-pull connector as defined in claim 2, wherein an outer edge of said at least one projection has an inclined surface.

4. The push-pull connector as defined in claim 3, wherein each said at spring hook has a central body portion and an angled upper edge extending from said body portion, said at least one projection inclined surface contacting each said angled upper edge when one of said shell and said housing are moved toward each other to flex each said spring hook central body portion and operate said pair of spring hooks toward said release position.

5. The push-pull connector as defined in claim 4, wherein said shell includes at least one pair of spaced projections, each said spring hook having a pair of spaced angled upper edges extending from said central body portion, said at least one pair of spaced projections contacting said pair of spaced angled upper edges to flex each said spring hook central body portion to operate said pair of spring hooks toward said release position.

6. The push-pull connector as defined in claim 5, wherein said shell includes two pairs of spaced projections arranged opposite pair each other.

7. The push-pull connector as defined in claim 6, wherein said shell contains a pair of opposing recesses each located between said pairs of spaced projections, respectively.

8. The push-pull connector as defined in claim 7, wherein said housing contains a pair of opposing recesses corresponding with said shell opposing recesses, said pair of spring hooks being connected with said housing opposing recesses, respectively.

9. The push-pull connector as defined in claim 8, wherein said shell is connected with said housing via at least one snap fit connection.

10. The push-pull connector as defined in claim 8, wherein said housing and said shell have generally rectangular configurations.

* * * * *